United States Patent [19]

Anthony

[11] 4,251,072

[45] Feb. 17, 1981

[54] MARBLE POOL GAME AND EQUIPMENT FOR PLAYING THE GAME

[76] Inventor: Wilson B. Anthony, 313 Carter St., Auburn, Ala. 36830

[21] Appl. No.: 935,986

[22] Filed: Aug. 22, 1978

[51] Int. Cl.[3] ..... A63D 13/00; A63D 15/00

[52] U.S. Cl. ..... 273/14; 273/123 R

[58] Field of Search ..... 273/118 R, 109, 1 D, 273/123 R, 108, 3 A, 6, 7, 14, 4 B, 85 R, 5 A, 9, 4 C, 126 R, 8

[56] References Cited

U.S. PATENT DOCUMENTS

| | | | |
|---|---|---|---|
| 680,759 | 8/1901 | Briggs | 273/11 C |
| 1,096,823 | 5/1914 | Breithut | 273/126 R |
| 1,943,697 | 1/1934 | Schuetz | 273/14 |
| 2,092,209 | 9/1937 | Gable | 273/126 R |
| 3,653,665 | 4/1972 | Wohlberg | 273/126 R |
| 4,017,079 | 4/1977 | Apellaniz | 273/126 R |
| 4,063,728 | 12/1977 | Zamanek | 273/7 |

*Primary Examiner*—Richard C. Pinkham
*Assistant Examiner*—T. Brown
*Attorney, Agent, or Firm*—Burns, Doane, Swecker & Mathis

[57] ABSTRACT

A marble game is played on a pocketed table in a manner similar to the game of pool. An elliptical boundary area is marked on the playing surface of the table, and the players shoot a taw from a taw zone at either end of the boundary area towards numbered marbles in an attempt to pocket the marbles. A player continues to shoot as long as he pockets a numbered marble and his taw stops within the boundary area.

6 Claims, 3 Drawing Figures

MARBLE POOL GAME AND EQUIPMENT FOR PLAYING THE GAME

BACKGROUND OF THE INVENTION

The present invention relates to a game to be played with marbles, and more particularly, to a marble game which can be played on the surface of a standard pocket billiards table.

The game of "marbles" is a very old and well known game. The game is traditionally played out of doors by children, and hence is seasonal in nature, being played mostly in the springtime. Furthermore, since the game is generally played on the ground and requires bending over and kneeling on the ground, the players are normally children only, since adults do not find such a game to be enjoyable.

One proposed modification of the game of marbles can be found in U.S. Pat. No. 1,943,697, issued to Schultz. This patent discloses a marble game which is played on a standard billiard table, and hence is capable of being played indoors year around and can be enjoyed by adults as well as children. The equipment necessary to adapt a billiard table to the game is somewhat bulky, however. When it is desired to play a regular game of billiards on the table, rather than the marble game, it is cumbersome to store the materials for the marble game in an out of the way place.

OBJECTS OF THE INVENTION

Accordingly, it is an object of the present invention to provide a novel marble game which can be played indoors and is therefore not seasonal in nature.

It is another object of the present invention to provide a novel marble game which can be enjoyed by adults as well as children.

It is a further object of the present invention to provide novel apparatus for a marble game which requires relatively few materials to adapt a standard pool table to be used for the novel marble game.

It is yet another object of the present invention to provide a novel and unique set of rules and regulations for playing a game of marbles.

These and other objects and advantages of the present invention will become apparent from a perusal of the following detailed description when read in conjunction with the appended drawings.

DESCRIPTION

Figure 1:
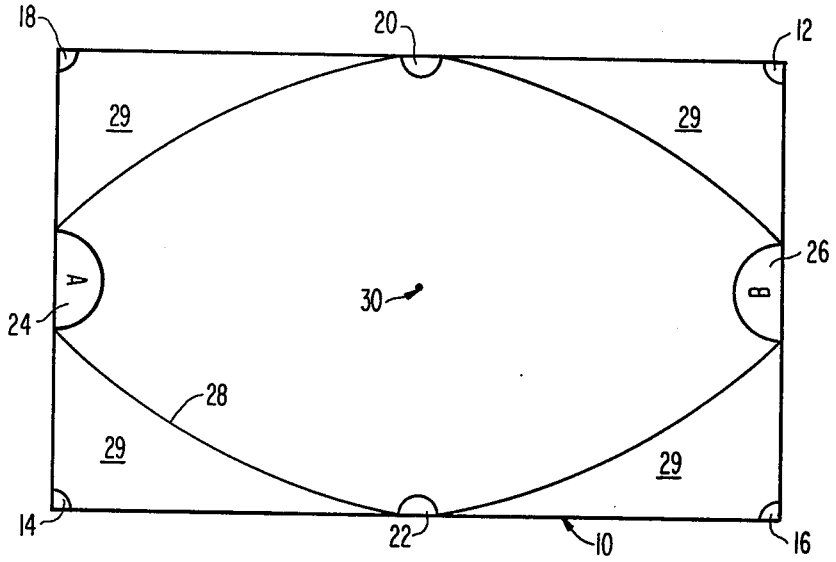
FIG. 1 is a top plan view of the playing surface for the marble game of the present invention.

The marble game of the present invention is played in a manner similar to the game of pocket billiards, more commonly known as "pool". That is, a player using a shooter marble labeled a taw directs the taw at one of a plurality of numbered marbles in an attempt to knock the numbered marbles into pockets on a playing surface. The playing surface for the marble pool game is illustrated in detail in FIG. 1.

The playing surface 10 for the marble game comprises a generally rectangular playing area. This playing area can be located on the surface of an ordinary pool table, and hence would be equal in size to the playing surface of most commonly found pool tables, e.g. five feet wide and eight feet long. The playing area is bounded on all sides by cushioned walls, or the like, which permit the marbles to rebound off the walls and remain on the playing area.

The playing surface includes four corner pockets 12, 14, 16 and 18 located respectively in each of the four corners of the rectangular playing surface. In addition, two side pockets 20 and 22 are located respectively in the center of each of the longer sides of the playing area, as commonly found on most pool tables.

Located in the center of each of the shorter sides of the playing surface are two taw zones 24 and 26. These taw zones 24, 26 may be formed by two semi-circles which can have a six inch radius, for example. Other suitable designs for the taw zones will be apparent, as well. A boundary line 28 is drawn on the rectangular playing surface. This boundary line is generally elliptical in shape, extending from one taw zone 24 to the other taw zone 26, and touching the sides of the playing surface at the location of the side pockets 20 and 22. The surface area encompassed by the boundary line 28 is less than the total area of the playing surface 10, to define an out-of-bounds portion 29 of the playing area. A racking point 30 is located at the center of the playing area, and designates the point at which the numbered marbles can be racked to begin play of the game.

The playing surface illustrated in FIG. 1 can be the horizontal surface of a table which is specially manufactured for playing the marble game of the present invention. Such a table would be quite similar to a common pool table, having side cushions to retain the marbles on the table and pockets for accomodating the marbles. The pockets are preferably about two square inches in size and the table can have cups 31 beneath the pockets (see FIG. 2) to hold the marbles when they are pocketed. The marbles can be readily removed from the cups and placed in racks located at the ends of the table (not shown), or at other convenient locations. The playing surface of the table is preferably covered with felt.

It will be apparent that it is not necessary to manufacture the marble game table to be the same size as most commonly found pool tables. The table can be made to be any size which is suitable for playing the marble game and can be stored in a convenient area.

Figure 3:
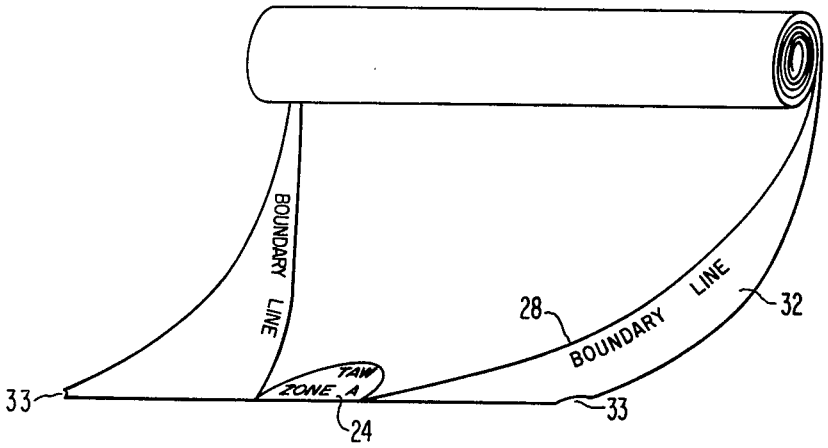
FIG. 3 is a view in perspective of a felt overlay which can be used to modify a pool table to play the marble game of the present invention.

Alternatively, a kit can be provided to adapt a conventional pool table to play the marble game. To adapt the pool table to play the game, the kit includes a felt overlay 32, such as that illustrated in FIG. 3, to be placed on the playing surface of the pool table. The felt overlay 32 is the same size as the pool table to which it is to be fitted, e.g. five feet by eight feet, and has the appropriate markings thereon for the taw zones 24, 26 and the boundary line 28. The felt overlay has cut-outs 33 in appropriate locations to accomodate the pockets of the pool table, i.e. at the corners and the centers of the two longer sides. Elastic bands or other suitable fastening devices can be attached to the overlay 32 to insure that the overlay will stay in place on the pool table while the marble game is being played.

Figure 2:
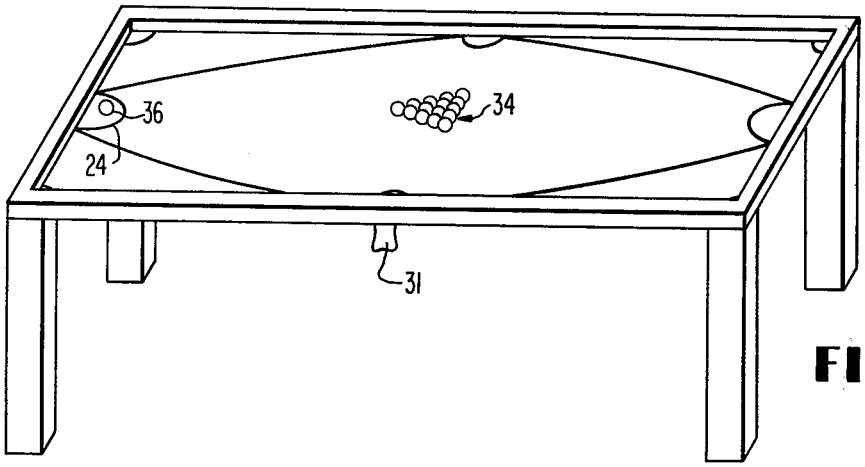
FIG. 2 is a view in perspective of a pool table modified to play the marble game of the present invention and set up in preparation for the game.

In addition to a table having a pocketed playing surface as illustrated in FIGS. 1 and 2, the equipment for the marble game of the present invention includes fifteen marbles which are color coded and numbered consecutively from one to fifteen. These marbles are approximately one half inch in diameter and can be made of ceramic or glass. In addition to the fifteen numbered marbles, one or more shooting marbles, labeled "taws", are provided. In order that they may impart a greater driving force to the marbles, the taws have a greater density than the numbered marbles. They are normally of the same diameter as the numbered marbles, and can be made of agate, ceramic or glass.

To play the game, the fifteen numbered marbles are racked in a triangular form 34 at the center of the table, such as is illustrated in FIG. 2. Any suitable number of players can play the game, and the players choose among themselves in any desired manner the player who is to shoot first.

The first player shoots a taw from the first taw zone 24 towards the rack of marbles 34. Due to the greater density of the taw, the numbered marbles will be driven forward upon impact while the taw will tend to stop at the point of impact.

If the first player is successful in knocking at least one of the numbered marbles into the pockets, and if his taw remains within the generally elliptical area defined by the boundary line 28, the player will continue to shoot. He will take his shot from the spot at which the taw came to rest within the boundary area. His shot with the taw must be aimed at the next marble in sequence remaining on the table, i.e. the marble with the lowest number marked thereon. A bank shot is permitted, but the taw must come to stop within bounds in order for the player to continue play. As long as the player pockets at least one marble on each shot and his taw comes to test within the boundary area, he can continue to shoot. If, however, he fails to pocket a marble, or his taw comes to rest outside of the boundary area, or he does not first hit the correct marble, his turn at play will come to an end. If a marble is pocketed when the taw stops out of bounds, the marble is counted for the player, but he loses his turn. If he should first hit the appropriate marble but pocket a different marble by reason of a hit of the appropriate marble which is driven by the taw, the player will receive the pocketed marble to his credit.

After the first player loses his turn at play, the second player begins by shooting at the lowest numbered marble remaining on the table. The second player initiates his play by shooting from one of the two taw zones which he has chosen prior to beginning of play. The second player's turn at play continues as long as he is able to pocket a marble on each shot and have his taw remain within the boundary area. Any marble which is hit and pocketed out of order is returned to the center spot on the table, and the player loses his turn without getting credit for the marble.

Any remaining players likewise initiate their play by shooting a taw from a chosen one of the two taw zones. The position from which a player begins shooting for second and subsequent turns at play is determined by the spot at which his taw came to rest on the play by which he lost his turn previously. If the previous shot came to rest out of bounds, the turn at play begins by shooting from the player's chosen taw zone. If, however, the taw came to rest within bounds at the end of the previous turn, the player will begin shooting from the location the taw occupies if it is still within the playing field at the beginning of his turn at play. If his taw has been moved out of bounds by another player, the player's first shot in his new turn is placed from within his chosen taw zone.

The play continues in this manner until all of the marbles have been pocketed. The player who has pocketed the number of marbles totaling the largest numerical value is the winner of the game.

It will be apparent that other modifications of the presently disclosed game come within the spirit of the present invention. For example, it is not necessary to use fifteen numbered marbles but any number of marbles which are suitable for play can be used. The marbles can be all alike, or they can be numbered to distinguish one from another. In addition, the number and location of the pockets, as well as the size of the playing surface, can be designed as found to be desirable.

The presently disclosed embodiments are considered in all respects as illustrative and not restrictive. The scope of the invention is indicated by the appended claims rather than the foregoing description, and all changes which come within the meaning and range of equivalency of the claims are therefor intended to be embraced therein.

What is claimed is:

1. A marble game comprising:

a substantially horizontal, rectangular playing surface bounded on all sides and having at least one pocket thereon;

means for defining a substantially elliptical boundary area on said playing surface, the area encompassed by said boundary area being less than the total area of said playing surface and having a taw zone located on the periphery of said boundary area at each of the remote ends and along the longitudinal axis thereof, each of said taw zones being of substantially identical configuration thereof;

a plurality of object marbles; and at least one shooter marble for shooting by a player in an attempt to knock said object marbles onto said pocket.

2. The marble game of claim 1 wherein said object marbles are consecutively numbered.

3. The marble game of claim 1 wherein said shooter marble is a taw having a density greater than the density of each of said object marbles.

4. A marble game comprising:

a substantially horizontal, rectangular playing surface bounded on all sides and having a pocket thereon in each of the four corners thereof;

means for defining a substantially elliptical boundary area on said playing surface, the area encompassed by said boundary area being less than the total area of said playing surface and having at least one taw zone located on the periphery of said boundary area;

a plurality of object marbles; and at least one shooter marble for shooting by a player in an attempt to knock said object marbles into said pocket.

5. The marble game of claim 4 further including a pocket located centrally of at least two of the sides of said playing surface.

6. Apparatus for enabling a marble game to be played upon a pocket billiards table; comprising:

an overlay adapted to be placed over the playing surface of a pocket billiards table to define a playing area for a marble game, said overlay having a substantially elliptical boundary area and a taw zone at each of the remote ends of said boundary area marked thereon and along the longitudinal axis thereof, each of said tow zones being of substantially identical configuration;

a plurality of object marbles to be placed in the playing area defined by said overlay; and at least one shooter marble for shooting by a player from one of said taw zones at said object marbles in an attempt to knock said object marbles in to the pockets of the table.

* * * * *